US006761383B2

(12) United States Patent
Ju

(10) Patent No.: US 6,761,383 B2
(45) Date of Patent: Jul. 13, 2004

(54) TAILGATE LATCH FOR VEHICLES

(75) Inventor: Young-Un Ju, Hwasung (KR)

(73) Assignee: Hyundai Motor Company, Seoul (KR)

( * ) Notice: Subject to any disclaimer, the term of this patent is extended or adjusted under 35 U.S.C. 154(b) by 166 days.

(21) Appl. No.: 09/991,195

(22) Filed: Nov. 20, 2001

(65) Prior Publication Data

US 2002/0063431 A1 May 30, 2002

(30) Foreign Application Priority Data

Nov. 24, 2000 (KR) ..... 2000-70375

(51) Int. Cl.[7] ..... E05C 3/06

(52) U.S. Cl. ..... 292/216; 292/201; 292/DIG. 23; 292/DIG. 53

(58) Field of Search ..... 296/216; 292/201, 292/DIG. 23, DIG. 53

(56) References Cited

U.S. PATENT DOCUMENTS 2,174,078 A * 9/1939 Burgin ..... 292/216
2,961,265 A * 11/1960 Jakeman et al. ..... 292/216
4,667,990 A * 5/1987 Quantz ..... 292/201
4,850,625 A * 7/1989 Hori et al. ..... 292/336.3
4,906,035 A * 3/1990 Nagai et al. ..... 292/201
4,948,184 A * 8/1990 Weyertall et al. ..... 292/216
4,974,885 A * 12/1990 Yokoyama ..... 292/201
5,035,449 A * 7/1991 Shiratori et al. ..... 292/48
5,035,453 A * 7/1991 Fukumoto et al. ..... 292/336.3
5,074,603 A * 12/1991 Brackmann ..... 292/216
5,118,146 A * 6/1992 Watanuki ..... 292/216
5,192,103 A * 3/1993 Fukumoto et al. ..... 292/216
5,273,325 A * 12/1993 Zimmermann ..... 292/216
5,295,374 A * 3/1994 Bender et al. ..... 70/208
5,411,302 A * 5/1995 Shimada ..... 292/201
5,639,130 A * 6/1997 Rogers et al. ..... 292/216
5,642,636 A * 7/1997 Mitsui ..... 70/237
5,738,393 A * 4/1998 Chao ..... 292/216
6,059,327 A * 5/2000 Yoshikuwa ..... 292/216
6,065,316 A * 5/2000 Sato et al. ..... 70/264
6,070,921 A * 6/2000 Valasin ..... 292/216
6,089,056 A * 7/2000 Yoda et al. ..... 70/208
6,123,372 A * 9/2000 Rogers et al. ..... 292/216
6,152,500 A * 11/2000 Kowalewski et al. ..... 292/216
6,267,420 B1 * 7/2001 Miyagawa ..... 292/216

* cited by examiner

*Primary Examiner*—Robert J. Sandy
*Assistant Examiner*—Carlos Lugo
(74) *Attorney, Agent, or Firm*—Christie, Parker & Hale, LLP

(57) ABSTRACT

A tailgate latch for vehicles having a bell crank that cooperates with a rotary arm of a key cylinder is provided. The bell crank has a slot formed at a middle section thereof for receiving a round pin formed at a middle section of a latch plate, by which the bell crank and the latch plate are cooperatively operated, such that a return position of the bell crank is restricted by the slot and the round pin, and wherein the latch plate is further removably hitched with a striker that is mounted at a body of a vehicle.

4 Claims, 2 Drawing Sheets

TAILGATE LATCH FOR VEHICLES

CROSS-REFERENCE TO RELATED APPLICATION

This application claims priority of Korea patent Application No. 2000-70375, filed on Nov. 24, 2000.

BACKGROUND OF THE INVENTION

Field of the Invention

The present invention relates to a tailgate latch for vehicles, and more particularly to a tailgate latch for vehicles constructed in simple structure for reduction in the number of parts and assembling processes, thereby decreasing manufacturing cost, improving operational reliability and easing key manipulation.

BACKGROUND OF THE INVENTION

Generally, a door of a vehicle (hereinafter referred to as door) is equipped with a door latch for maintaining a closed state and for releasing the closed state to enable the door to be opened. Leisure and sports vehicles such as sports utility vehicles (SUV) and the like are also mounted with latches to their rear doors of tailgates.

As illustrated in FIG. 1, a latch at a tailgate is equipped with a base plate 10 formed with a bend piece 11 and stoppers 12 and 13, a housing 20 disposed underneath the base plate 10 for providing an inlet to a striker 21 and for protecting latch parts and for mounting a latch to the tailgate, a bell crank 30 for rotatably being mounted on the base plate 10 via a rivet 40 and formed with a round pin 31 and a press pin 32, a return spring 41 mounted on the rivet 40 while respectively secured at both ends thereof to the bend piece 11 of the base plate 10 and to the bell crank 30 for pushing the bell crank 30 toward the stopper 12, a latch plate 50 rotatably formed at the base plate 10 via a rivet 42 while constructed with an upper piece 51, a middle piece 52 and a lower piece 53 where the middle piece 52 is defined by a round pin 54 pressed by the press piece 32 of the bell crank 30 and the lower piece 53 is formed with a bend 55, a return spring 43 having both ends each connected to the bend piece 55 of the latch plate 50 and to inner wall surface of the housing and pulling the latch plate 50 toward a direction where the upper piece 51 is brought into contact with the stopper 13, a key cylinder 60 connected to the round pin 31 of the bell crank 30 and formed with a rotary arm 61 for supplying an action force, an actuator 70 mounted at the base plate 10 and formed with a rotary piece 71 for rotary action with supplied power, and a rod 72 for connecting the rotary piece 71 of the actuator 70 with the upper piece 51 of the latch plate 50.

When a key is inserted into the key cylinder 60 and to be rotated, the rotary arm 61 is rotated to clockwise rotate the bell crank 30 and the press piece 32 presses the round pin 54 at the latch plate 50, such that the latch plate 50 is counterclockwise rotated to be introduced through a downward opening of the housing 20, where the striker 21 hitched at the latch plate 50 is released from restriction to open the tailgate.

Successively, when the key is pulled out of the key cylinder 60, the latch plate 50 is clockwise rotated by the return spring 43 to return to an original position while the bell crank 30 is also returned to its original position by action where the round pin 54 of the latch plate 50 pushes the press piece 32 and simultaneously by action of the return spring 41 at the bell crank 30.

Meanwhile, the actuator 70 is operated by switch manipulation of a driver, where, when a switch is turned on, the rotary piece 71 at the actuator 70 is rotated counterclockwise to pull the rod 72, whereby the latch plate 50 is rotated counterclockwise as pressed by the bell crank 30 to release the restricted state of the striker 21, thereby operating the tailgate, where return action of the latch plate 50 is made to occur by way of the return spring 43 as described above.

However, there is a problem in the tailgate latch thus described according to the prior art in that the stoppers 12 and 13 are respectively formed at the base plate 10 for restricting the return position of the bell crank 30 and the latch plate 50 and the bend piece 11 is formed for disposition of the return spring 41 at the bell crank 30, complicating shapes of the base plate 10 while, even though the stoppers 12 and 13 are respectively covered by cushioning rubber covers 14 for alleviating shock when the bell crank 30 and the latch plate 50 are returned, and the bell crank 30 is automatically returned by the return of the latch plate 50 during return operation, the return spring 41 is additionally used to increase the number of parts, thereby increasing the number of assembling process and manufacturing cost.

There is another problem in that the return operation of the bell crank 30 is not properly realized due to decreased durability strength of the return spring 41 at the bell crank 30, thereby resulting in a poor return operation of the latch plate 50 and abnormal operation of the latch.

There is still another problem in that reaction force of the return spring 41 at the bell crank 30 is generated in addition to that of the return spring 43 at the latch plate 50, thereby calling for more power for manipulating the key.

SUMMARY OF THE INVENTION

The present invention is disclosed to solve the aforementioned problems and it is an object of the present invention to provide a tailgate latch for vehicles constructed free of bend piece and stoppers for bell crank to simplify the shape of a base plate, thereby reducing the number of rubber covers.

It is another object of the present invention to provide a tailgate latch for vehicles constructed free of return spring to reduce the number of overall parts and the number of assembling process and manufacturing cost, thereby eliminating abnormal operation of latch due to improper operation of return spring for bell crank.

There is still another object of the present invention to provide a tailgate latch for vehicles constructed free of return spring for bell crank to reduce a key manipulating force.

In accordance with one object of the present invention there is provided a tailgate latch for vehicles, the latch comprising:

a bell crank having a slot; and a latch plate having a pin movably inserted in the slot and formed to be releasably coupled to a striker mounted at a body of the vehicle, wherein the latch further comprising:

a base plate;

a bell crank rotatably mounted to the base plate;

a return spring for returning the latch plate to its original position;

a key cylinder having a rotary arm for rotating the bell crank; and an actuator having a rotary piece connected to the latch plate via a rod for rotating the latch plate.

BRIEF DESCRIPTION OF THE DRAWINGS

For fuller understanding of the nature and objects of the invention, reference should be made to the following detailed description taken in conjunction with the accompanying drawings in which.

DETAILED DESCRIPTION OF THE INVENTION

Preferred embodiment of the present invention will now be described with the accompanying drawing.

Figure 1:
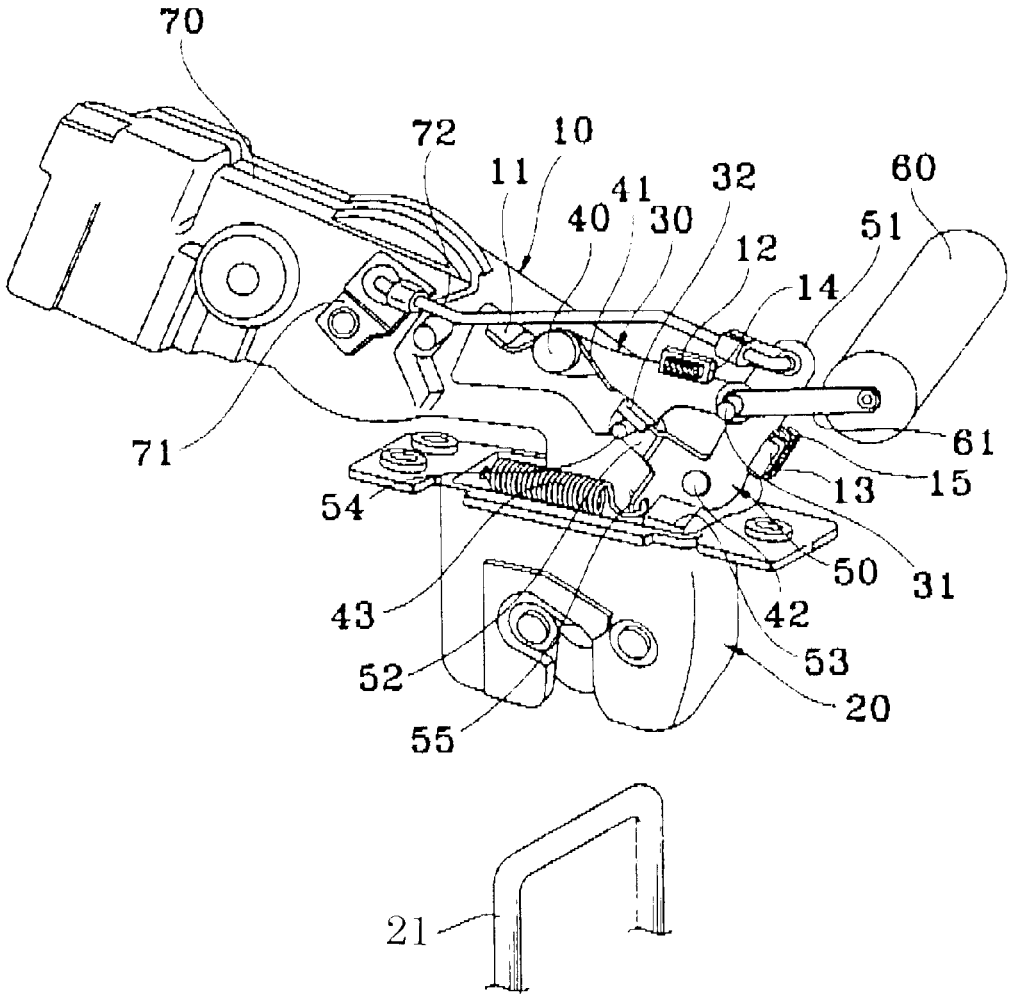
FIG.1 (prior art)
FIG. 1 is a perspective view for illustrating a tailgate latch for vehicles according to the prior art.
Figure 2:
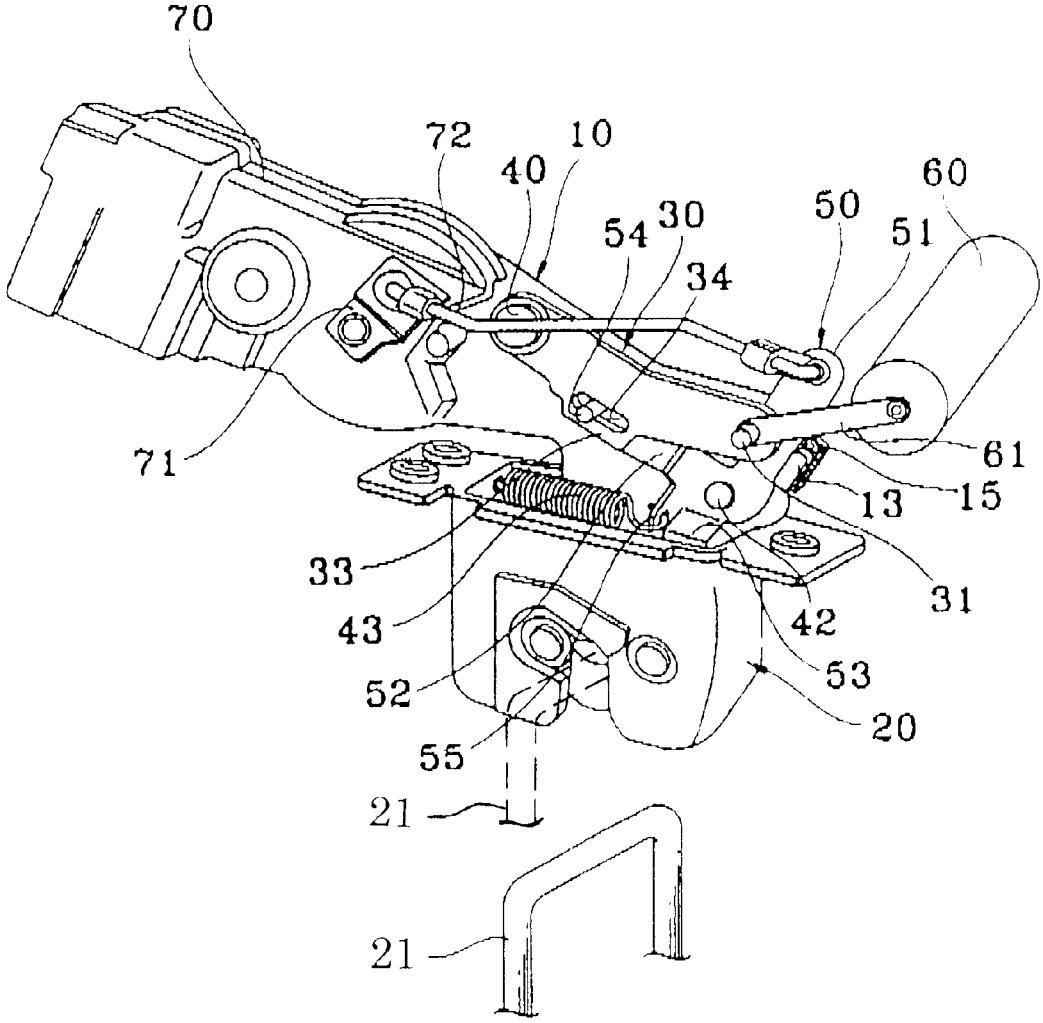
FIG. 2 is a perspective view for illustrating a tailgate latch for vehicles according to the present invention.

FIG. 2 is a perspective view for illustrating a tailgate latch for vehicles according to the present invention, where the present invention includes a base plate 10, a housing 20 mounted underneath the base plate 10 for providing an inlet to a striker 21 and for protecting latch parts and for mounting a latch to the tailgate, a bell crank 30 rotatably mounted via a rivet 40 to an upper surface of the base plate 10 and formed at a downwardly-extended middle section 33 with a slot 34 having both ends, each of round shape and formed at a tip end thereof with a round pin 31, a latch plate 50 rotatably mounted via a rivet 42 at a right side of the base plate 10 and having an upper piece 51, a middle piece 52 and a lower piece 53 where the middle piece 52 is formed with a round pin 54 for insertion into the slot 34 of the middle section 33 at the bell crank 30 while the lower piece 53 is formed with a bend piece 55, where return position is restricted by a stopper 13 formed at the base plate 10 and covered by a rubber cover 15, a return spring 43 secured at both ends thereof to an inner wall of the housing 20 and the bend piece 55 formed at the lower piece 53 of the latch plate 50, a key cylinder 60 having a rotary arm 61 connected to the round pin 31 of the bell crank 30, and an actuator 70 for actuating a rotary piece 71 by way of power to pull the upper piece 51 by way of operation of a rod 72 connected to the rotary piece 71, thereby rotating the latch plate 50.

In other words, in the present invention, the housing 20, latch plate 50, return spring 43 for the latch plate 50, key cylinder 60, actuator 70, rotary piece 71 connected thereto and the rod 72 are the same as those of the prior art in shapes and constructions thereof.

However, in the present invention, the middle section 33 is formed at the bell crank 30 and the middle section 33 formed with the slot 34 is inserted by the round pin 54 mounted at the middle piece 52 of the latch plate 50, while, the return spring is not disposed at the rivet 40 of the bell crank 30 such that a bend piece for securing a tip end of return spring for bell crank to the base plate 10 is not formed, nor a stopper for restricting a return position of the bell crank is formed whereby no rubber cover for the stopper is used.

Now, operation of the present invention will be described.

When a user turns a key in the key cylinder 60, the rotary arm 61 is rotated counterclockwise, and when the bell crank 30 is rotated clockwise about the rivet 40 in cooperation with the rotary arm 61, the bell crank 30 presses the round pin 54 formed at the middle piece 52 of the latch plate 50 to rotate the latch plate counterclockwise, thereby releasing a restricted state of the striker 21.

At this time, the round pin 54 of the latch plate 50 is moved downward within the slot 34 of the bell crank 30. Successively, when the key is pulled out of the key cylinder 60 to leave the rotary arm 61 free of force, the bell crank 30 and the latch plate 50 become free to shrink the pulled return spring 43 and to rotate the latch plate 50 clockwise, thereby returning to an original position of contacting the stopper 13 such that the round pin 54 of the latch plate 50 rises along the slot 34 to push the bell crank 30 upward, thereby returning the bell crank 30 to its original position. In this location, the round pin 54 is positioned at an upper end of the slot 34.

In other words, because the bell crank 30 is able to return to its original position without the assistance of an exclusive return spring and is restricted in its rising position by the round pin 54 of the latch plate inserted in the slot 34, there is no need of forming a stopper at the base plate 10 for restricting the returned position of the bell crank 30 such that there is no need of rubber cover to the stopper.

Furthermore, a bend piece for fixing a tip end of return spring is not needed to be formed at a base plate due to no use of return spring for bell crank, such that the base plate 10 is simplified in shape thereof, and the number of parts and assembly process are reduced as well as the manufacturing cost.

Still furthermore, erroneous operation of bell crank resultant from decreased durability of return spring and discrepant operation state of latch caused therefrom can be eliminated by disused application of return spring for the bell crank to improve credibility of latch operation.

Still furthermore, less power will be employed in turning a key because only reaction force of return spring 43 for latch plate is to be coped with.

As apparent from the foregoing, there are advantages in a tailgate latch for vehicles thus described according to the present invention in that a base plate is simplified in shape thereof, and the number of parts and assembling processes are reduced whereby manufacturing costs are decreased such that durability of and operational credibility of latch are improved to thereby allow easy manipulation of key.

What is claimed is:

1. A tailgate latch for vehicles, the latch comprising:

a bell crank having a slot;

a latch plate having a pin movably inserted in the slot, wherein the latch plate is releasably hitched with a striker that is fixedly mounted at a body of the vehicle; and a return spring for returning the latch plate to its original position.

2. A tailgate latch for vehicles, the latch comprising:

a bell crank having a slot;

a latch plate having a pin movably inserted in the slot, wherein the latch plate is releasably hitched with a striker that is fixedly mounted at a body of the vehicle;

a key cylinder having a rotary arm for rotating the bell crank; and an actuator having a rotary piece connected to the latch plate via a rod for rotating the latch plate.

3. A tailgate latch for a vehicle, the latch comprising:

a base plate integrally assembled with an electric actuator and a housing that receives a striker that is fixedly mounted at a body of the vehicle;

a bell crank having a slot, wherein the bell crank is rotatably mounted to the base plate;

a latch plate having a pin movably inserted in the slot, wherein the latch plate releasably engages the striker when the housing is rotated by the bell crank or the electric actuator;

a return spring for returning the latch plate to its original position; and a key cylinder having a rotary arm for rotating the bell crank.

4. The latch as defined in claim 3, wherein the electric actuator has a rotary piece that is connected to the latch plate via a rod, wherein rotation of the rotary piece moves the rod which, in turn, rotates the latch plate.

* * * * *